United States Patent [19]

Rabinovitch et al.

[11] 4,147,201

[45] Apr. 3, 1979

[54] METHOD OF MANUFACTURING OF A METALLURGICAL MOLD

[75] Inventors: Maurice Rabinovitch, Chatillon; Pierre Magnier, Chatenay-Malabry, both of France

[73] Assignees: Office National d'Etudes et de Recherches Aerospatiales (O.N.E.R.A.), Chatillon; Microfusion S.A., Gennevilliers, both of France

[21] Appl. No.: 659,014

[22] Filed: Feb. 18, 1976

[30] Foreign Application Priority Data

Feb. 20, 1975 [FR] France ..... 75 05345

[51] Int. Cl.[2] ..... B22C 9/04; B22C 7/02

[52] U.S. Cl. ..... 164/35; 164/6; 164/19; 164/34; 164/41; 164/46

[58] Field of Search ..... 164/34, 46, 41, 23, 164/19, 20, 138, 72, 25, 60, 361, 35, 36, 37

[56] References Cited

U.S. PATENT DOCUMENTS

| | | | |
|---|---|---|---|
| 2,788,555 | 4/1957 | Sukacev | 164/34 |
| 3,136,011 | 6/1964 | Peras | 106/38.27 |
| 3,182,361 | 5/1965 | Trimble | 164/19 |
| 3,801,334 | 4/1974 | Dewey, Jr. | 164/36 X |
| 3,802,482 | 4/1974 | Phipps, Jr. | 164/72 |
| 3,973,750 | 8/1976 | Rabinovitch et al. | 249/114 |

FOREIGN PATENT DOCUMENTS

| | | | |
|---|---|---|---|
| 636224 | 2/1962 | Canada | 164/19 |

*Primary Examiner*—Richard B. Lazarus
*Assistant Examiner*—Gus T. Hampilos
*Attorney, Agent, or Firm*—Karl F. Ross

[57] ABSTRACT

A method of manufacturing a mold adapted to be used for casting bodies of fiber-reinforced composites. A model of the body to be cast is prepared and coated with a one piece dense shell of refractory metallic oxide deposited by plasma or flame spraying and the model is then separated from the shell by conventional physical or chemical treatment.

1 Claim, 5 Drawing Figures

37
36
33
32
30
34
35
38
31
f
39

METHOD OF MANUFACTURING OF A METALLURGICAL MOLD

This invention has as its object the provision of a method of manufacturing a metallurgical mould.

The invention also has as its object the provision of an improved metallurgical mold.

It has already been suggested in the copending U.S. patent application No. 593,669 dated July 7, 1975 (now U.S. Pat. No. 3,973,750), in the name of Rabinovitch et al. and assigned to OFFICE NATIONAL D'ETUDES ET DE RECHERCHES AEROSPATIALES to use a metallurgical mold for the manufacture of metal parts made of a composite refractory material comprising a super alloy matrix in which is present a reinforcing phase consisting of oriented fibers of high mechanical resistance characteristics and obtained by unidirectional solidification of an appropriate initial alloy. Such materials, disclosed in the U.S. Pat. No. 3,871,835 dated Mar. 18, 1975 (assigned to OFFICE NATIONAL D'ETUDES ET DE RECHERCHES AEROSPATIALES) are polyvariant fiber-reinforced composites having a eutectic-type structure consisting essentially of two distinct independent phases constituted by:

(a) a complex multicomponent matrix phase consisting essentially of:
   i. at least one metal selected from the group consisting of Fe, Ni and Co, and
   ii. chromium in an amount between 10 and 25 percent by weight of the composite; and in said matrix:

(b) an in situ grown reinforcing phase free from chromium and consisting essentially of whisker-like elongated monocrystalline fibers of at least one metal monocarbide, the metal of which is selected from the group constituted by Ta, Nb, Hf and Ti.

These materials, rich in carbon, are produced by unidirectional solidification of an appropriate initial alloy by heating at a temperature comprised between 1300° and 1700° C., the temperature gradient at the solidification front being of the order of 100° to 150° C./cm and the progression speed of the solidification front being comprised between 0.5 and 6 cm/hour.

The mold disclosed in the above-mentioned application is manufactured by assembly of two parts each consisting of a body made of a material having good heat conductivity such as graphite, internally lined with a coating of metallic refractory oxide deposited by blow-pipe projection. By reason of this manufacturing technique, the operating surface of the mold, that is, the surface in contact with the alloy which undergoes the unidirectional solidification process, is rough. This roughness and the presence of an assembly junction plane of the two parts make it impossible to obtain with the known mold, cast parts having directly the precision characteristics required for certain mechanical organs of complex shape, such as aeronautical turbine blades, so that these items must then subjected to machine-finishing of coarser parts.

Although casting by the so called "lost wax" method is of current use for the manufacture of complex shape parts and although it has already been suggested, for example in British Pat. No. 767 114 (Fairley Aviation Company Limited), to provide a coating on the operating surface of the mold used for such a method, no manufacturing process is known to date making it possible to obtain a mold satisfying both the physical and chemical conditions imposed by the formation of metallic parts of complex shape made from the materials specified hereinabove that is planar solidification front, high temperature gradient at the solidification interface, low speed of progression of the solidification front, high temperature of casting, chemical inertia at high temperature to prevent any reaction between the mold and the constituents of the alloy.

It is the object of this invention to provide a method of manufacturing a metallurgical mold which does not possess the abovementioned drawbacks of known molds and which thus permits direct casting of metallic parts having the dimensional precision characteristics and surface state required.

It is also an object of this invention to provide a method of manufacturing at low cost such a mold, if desired in a large number of identical copies, such that the cost of the metallic parts in the hereinabove mentioned materials is reduced.

The method of manufacturing a metallurgical mold according to this invention comprises preparing a model of the desired part, at least the external surface of which has a melting point sufficiently high to resist deposit of a refractory metallic oxide by plasma or flame spraying, and deposit a metallic oxide layer on the model to form a one-piece shall, the model being separated from said shell by a physical or chemical treatment.

In a preferred embodiment, a ceramic coating of greater porosity and of greater thickness than that of said shell is applied by potting on the external surface of the shell.

In an embodiment of the method, the model of the desired part is made of metal or of an alloy which can be easily dissolved by a chemical attack process, for example an alloy of aluminum and silicon.

When the model is metallic, it is first slightly sanded before the refractory metallic oxide is deposited and said deposit of oxide is made under constant severe cooling by means of jets of air or the like.

In another embodiment of the method, the model is a thin shell obtained by electrolytical deposit of a metal on a wax shape covered, before the deposit of said metal, by a silver film or the like applied by chemical means.

In yet another embodiment of the method of model of the desired part is a metallic shape covered on its external surface by a layer of salt soluble in water, applied by vaporization and the refractory metallic oxide shell is separated from said metal by dissolving the salt layer in a water bath.

In this case the model is maintained at a temperature higher than that of the vaporization of water during all the salt layer deposition step and said salt layer is afterwards smoothed by polishing with emery cloth or the like.

Preferably the refractory metallic oxide shell is applied by means of an apparatus similar to a lathe, the chuck of which rotates the model of the part and the carriage of which carries the means for projecting the oxide against the model and is caused to move to-and-fro parallel to the axis of the chuck.

The invention will be more clearly understood by the following description which is given as an example only, reference being made to the appended drawing in which.

Figure 1:
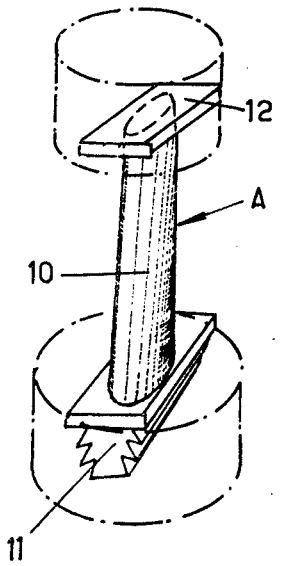
FIG. 1 is a perspective view of a turbo-machine blade.

The invention is hereinafter described as being applied to the manufacture of a turbo-machine blade such as illustrated in FIG. 1, but it should be clear that this indication has no limitative character whatsoever.

A turbo-machine blade A comprises, as known, a blade 10 one extremity of which carries a securing means 11 and the other extremity of which is either free or carries a heel 12. When intended for use in high performance aeronautical turbines, the blade A is made of composite refractory material obtained by unidirectional solidification of an appropriate initial alloy and comprising for example an iron, a cobalt or nickel and chromium base matrix and a reinforcing phase constituted of long monocrystalline fibers made of monocarbides of transition metals, such material presenting principally a high resistance to creep at high temperature. Whereas blades in a material such as specified hereinabove are presently manufactured by machine-finishing of rough parts having approximately the required shape the invention provides a manufacturing method by a mold enabling them to be cast directly at least for the blade proper.

Figure 2:
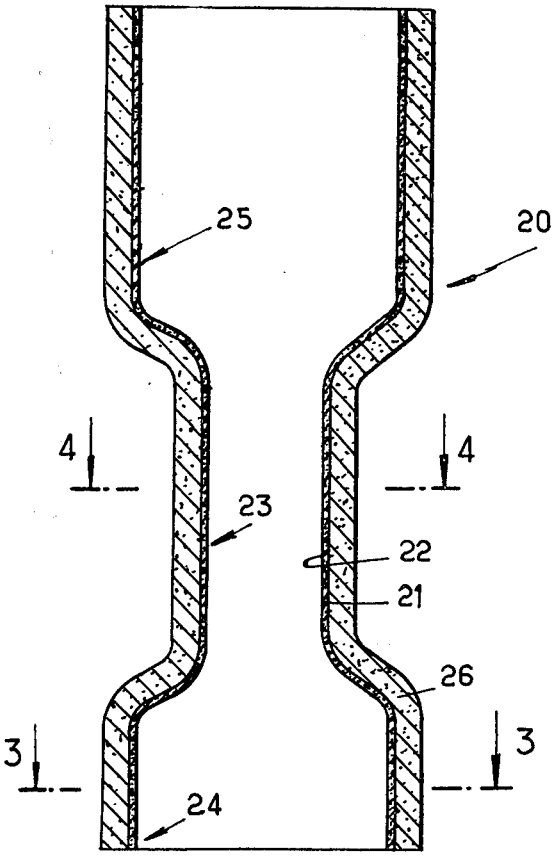
FIG. 2 is a longitudinal sectional view of a mold produced by the method according to this invention for the manufacture of the blade shown in FIG. 1.
Figure 3:
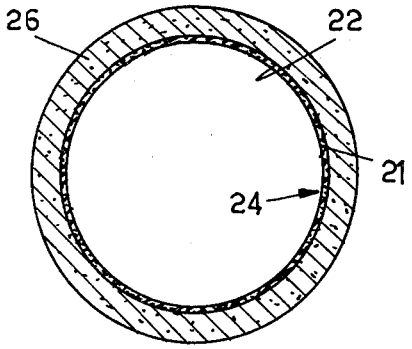
FIG. 3 is a sectional view along line 3—3 of FIG. 2.
Figure 4:
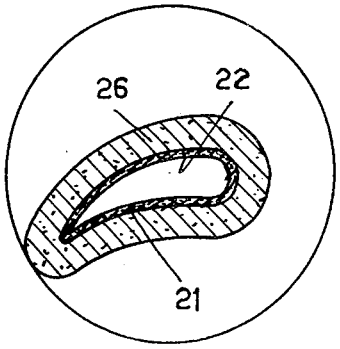
FIG. 4 is a sectional view along line 4—4 of FIG. 2.

The mold 20 according to this invention 20, FIGS. 2 and 4, comprises a thin non-porous layer of refractory metallic oxide of high purity forming a one-piece shell 21 the internal surface 22 of which is smooth and comprises a central portion 23 of a shape complementary to the shape of the blade 10 and extremal parts of a shape complementary to that of the securing means 11 and of the heel 12 or parts of general cylindrical form 24 and 25 in which can be machined the securing means and the heel.

The metallic oxide constituting of the shell 21 of high purity (equal to or greater than 99.5%) is preferably chosen from the group consisting of aluminum oxide, zirconium oxide and magnesium oxide the melting point of which is greater than 2000° C. Such a metallic oxide is adapted to resist high thermal gradients which arise when unidirectional solidification of the alloy is carried out (of the order of 100° to 150° C./cm) and because of its purity, its chemical inertia at high temperature (from 1300° to 1700° C.) ensures the absence of reaction with the constituents of the alloy under treatment which is rich in carbon.

The shell 21, which can be manufactured as method of which will be described hereinafter is dense (porosity less than 10%) and thin, its thickness being comprised for example between 0.5 and 1 mm when the refractory oxide is aluminum oxide. The shell 21 is sufficiently strong to be used such as is for the manufacture of small dimension parts.

For parts of large dimensions the shell 21 is coated externally with a refractory coating 26 of greater thickness of the order of 4 or 5 mm which can be obtained by potting and is thus of greater porosity than that of the shell 21, for example of the order of 30%, the said coating mechanically strengthening the mold and increasing its resistance to thermal stresses during use.

The absence of junction plane in the shell and the presence of an operating surface 22 which is very smooth make it possible to obtain directly by casting blades A having the dimensions and the surface quality required.

The method according to this invention for the manufacture of a mold such as the one just described is characterized in that the refractory oxide coating is shaped as a one-piece shell by deposit of the oxide on a model of the desired piece, at least the external surface of the model has a melting point sufficiently high to resist deposit of the refractory metallic oxide by plasma or flame spraying, the model being then separated from the shell by a physical or chemical treatment.

In a first embodiment, a model made of a metal or of an alloy of low cost is first manufactured by the so called lost wax process and on said model is then projected with an oxiacetylenic blow-pipe or a plasma blow-pipe the refractory metallic oxide constitutive of the shell 21.

The metal or alloy of the metal chosen is such that, on one hand, it has a high melting point and can thus resist to the projection of refractory oxide, and on the other hand that it can be easily eliminated after constitution of the shell.

Good results have been obtained with the alloy known by the name of Alpac (A1-Si) which after having received a coating of refractory oxide is dissolved by attack with acid.

EXAMPLE 1

Figure 5:
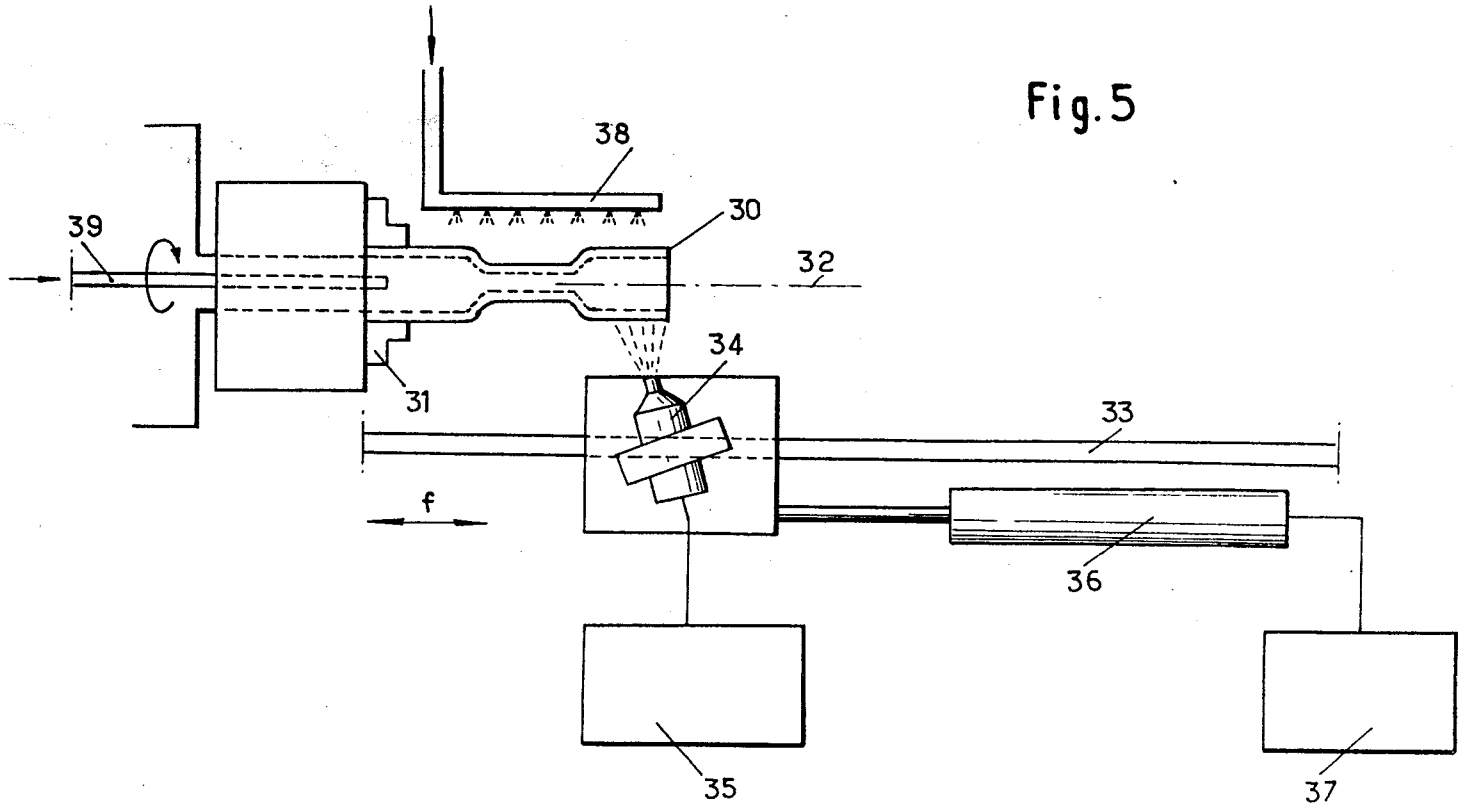
FIG. 5 is a schemtic illustration of an apparatus for carrying out the method according to this invention.

To manufacture directly by casting a blade A with a height of approximately 50 mm, a mold is used with a height of 140 mm with cylindrical end parts of 45 mm in diameter obtained as follows:

(a) by a lost wax process a model of the blade presenting the desired characteristics of precision and surface state in cast in Alpax;

(b) the model thus formed undergoes a slight sanding intended to eliminate from its surface any trace of oxide of or grease, like fingermarks, such a sanding enhancing satisfactory the satisfactory adherence of the refractory metallic oxide which is to form the shell of the mold;

(c) for the deposit of the layer of refractory oxide the Alpax model 30, FIG. 5, is fixed on a chuck 31 rotating around its axis 32. On a slide piece 33 parallel to axis 32 is mounted for translation in the direction of the double arrow f a blow-pipe 34 connected to a feeding source 35, the movement of the blow-pipe being controlled by means of a hydraulic jack 36 from a displacement control order generator 37.

To prevent any risk of cracking of the aluminum oxide coating projected by the blow-pipe 34 during displacement in translation of the latter, i.e. cracks which could appear because of the expansion of the model 30 during deposit of the refractory metallic oxide, the model is cooled by projection of air under pressure distributed both to a distributor 38 which is parallel to axis 32 and external to model shape 30 and to a duct 39 directed along axis 32 inside the model. By maintaining the temperature of the model under 60° C. an aluminum oxide of very high purity (equal or greater than 99.5%) dense (porosity coating less than 10%) of a thickness comprised between 0.5 and 1 mm and presenting no cracks is deposited on the Alpax model in about twenty runs of the blow-pipe 34.

(d) After the model 30 coated with the shell 21 has been extracted from the chuck 31, it is immersed in an aqueous bath of hydrochloric acid at 30% in volume, which is constantly cooled by water circulation to prevent any fissuration of shell 21 by the effect of the exothermical reaction of attack of the model. When the latter is completely dissolved, after about 24 hours, the shell is removed from the bath, is washed and dried;

(e) eventually, a strengthening coating 26 is then applied on the external surface of the shell, after having closed its end portions by caps, and this by soaking in a powder-containing ceramic mud of the viscous coating and drying.

To eliminate the relatively long phase of dissolution of the metallic model, the invention provides in a second embodiment to constitute said model as a thin shell. To this end a thin film on silver is deposited by chemical means of a wax shape realized by injection and on this film is formed a thin shell of nickel of the order of some tenths of millimeter in thickness, by electrolytic technique.

After elimination by fusion of the wax, the refractory metallic oxide is projected by the blow-pipe on the nickel shell which is then eliminated by chemical means.

EXAMPLE 2

To manufacture a mold of the type described in example 1, a wax shape is produced which, after a slight wet sanding,is covered with a thin silver film deposited by chemical means. On this thin film is then transferred in a manner as regular as possible an electrolytic deposit of nickel the thickness of which is of the order of 0.3 to 0.5 mm.

The wax of the shape is then melted and the model constituted by the nickel shell is mounted on the chuck 31 of the apparatus illustrated in FIG. 5 for the applying the refractory metallic oxide shell in aluminum oxide, zerconium oxides or magnesium oxide.

When the desired thickness of the shell is obtained, after about twenty runs of the blow-pipe 34, it is taken away from the chuck and put in a chemical attack bath, consisting of an aqueous solution of nitric acid at 50% in volume which dissolves the nickel shell in about half an hour.

The refractory metallic oxide shell extracted from the acid bath is washed and dried. It is eventually coated externally by a strengthening coating obtained by potting.

In a third embodiment, to be used mainly for parts of simpler shape, the refractory metallic oxide shell 21 is not directly formed on a metallic support but on a uniform thin layer of a salt soluble in water transferred on said model, and which after formation of the shell is eliminated by dissolution in water; the metallic support can thus be reused many times.

EXAMPLE 3

On a metallic model of the type used in Example 1 a solution of sodium chloride in water is projected by a conventional atomizing pistol. Atomizing is carried out with an apparatus similar to that shown in FIG. 5 but in which the external cooling ramp 38 is deleted whereas the axial ramp 39 is replaced by a heating ramp, preferably electrically heated, regulated to maintain the model at a temperature of approximately 200° C. in such a way that the water of the droplets of the salt solution projected by the pistol mounted instead and in place of pistol 34 evaporates rapidly as they reach the metallic model.

The layer of deposited salt which is slightly rough is then softened with a fine emery-cloth and the atomizing pistol being replaced by the blow-pipe 34 to project aluminum oxide zirconium oxide or magnesium oxide the shell 21 is formed in a way similar to that described hereinabove. The high melting point (800° C.) of sodium chloride enables it to sustain heating in the course of projection of the refractory metal oxide without any deterioration of the salt layer.

After taking away from the chuck 31 the assembly of the metallic model, the layer of salt, and the shell of refractory oxide, said assembly is placed in a water bath, the sodium chloride layer dissolves and the metallic model which can be re-used is extracted from the shell. The latter is dried and eventually coated with an external potting.

We claim:

1. A method of making a mold for the directional solidification of a metall alloy composite to produce parts of complex shape of refractory directionally solidified polyvariant fiber-reinforced composite having eutectic-type structure consisting essentially of two distinct independent phases constituted by:

(a) a complex multicomponent matrix phase consisting essentially of:

i. at least one metal selected from the group consisting of Fe, Ni and Co, and ii. chromium in an amount between 10 and 25 percent by weight of the composite;

and in said matrix:

(b) an in situ grown reinforcing phase free from chromium and consisting essentially of whisker-like elongated monocrystalline fibers of at least one metal monocarbide, the metal of which is selected from the group constituted by Ta, Nb, Hf and Ti, said method comprising the steps of:

preparing a model of a part to be produced by forming a wax shape of the part to be produced, chemically applying a silver film to said wax shape, and electrolytically depositing a metal forming an external surface of said model on said silver film, said external surface having a melting point sufficiently high to resist deposit by plasma or flame spraying of a refractory metal oxide selected from the group which consists of aluminum oxide, zirconium oxide and magnesium oxide having a purity of at least 99.5%;

depositing by plasma or flame spraying onto said model a one piece thin, dense and nonporous shell of said oxide; and separating said shell from said model by a physical or chemical treatment whereby said separated shell forms said mold.

* * * * *